US008203456B2

(12) United States Patent
Luo et al.

(10) Patent No.: US 8,203,456 B2
(45) Date of Patent: Jun. 19, 2012

(54) FIRE DETECTING SYSTEM AND WEIGHT CORRECTING METHOD PERFORMED THEREBY

(75) Inventors: Ren-Chyuan Luo, Taipei (TW); Kuo-Lan Su, Chiayi County (TW); Jyh-Hwa Tzou, Chiayi County (TW)

(73) Assignee: National Taiwan University (TW)

( * ) Notice: Subject to any disclaimer, the term of this patent is extended or adjusted under 35 U.S.C. 154(b) by 521 days.

(21) Appl. No.: 12/534,963

(22) Filed: Aug. 4, 2009

(65) Prior Publication Data

US 2010/0033334 A1 Feb. 11, 2010

(30) Foreign Application Priority Data

Aug. 6, 2008 (TW) ..... 97129813 A

(51) Int. Cl.
*G08B 17/12* (2006.01)

(52) U.S. Cl. ..... 340/577; 340/506; 340/511

(58) Field of Classification Search ..... 340/577, 340/506, 511, 514, 628, 870.01; 348/143
See application file for complete search history.

(56) References Cited

U.S. PATENT DOCUMENTS

| | | | | |
|---|---|---|---|---|
| 5,936,533 | A * | 8/1999 | Bernal et al. | 340/628 |
| 6,756,906 | B2 * | 6/2004 | Bernal et al. | 340/511 |
| 7,142,123 | B1 * | 11/2006 | Kates | 340/870.01 |
| 7,336,168 | B2 * | 2/2008 | Kates | 340/506 |
| 7,528,711 | B2 * | 5/2009 | Kates | 340/506 |
| 7,595,815 | B2 * | 9/2009 | Donovan et al. | 340/506 |
| 7,777,634 | B2 * | 8/2010 | Kaelin et al. | 340/628 |
| 7,876,351 | B2 * | 1/2011 | Donovan et al. | 348/143 |

* cited by examiner

*Primary Examiner* — John A Tweel, Jr.
(74) *Attorney, Agent, or Firm* — Ostrolenk Faber LLP

(57) ABSTRACT

A fire detecting system includes a plurality of detectors, and a computing unit coupled to the detectors. The detectors are configured for generating a plurality of detecting values, respectively. For each of the detectors, the detecting value is equal to a first predetermined value when a fire state is detected thereby, and is equal to a second predetermined value when otherwise. The computing unit sets a weight value for each of the detectors and a threshold value, and is configured to perform a weight correcting method for correcting the weight value of each of the detectors based on accuracy of operation of the detectors.

20 Claims, 4 Drawing Sheets

FIRE DETECTING SYSTEM AND WEIGHT CORRECTING METHOD PERFORMED THEREBY

CROSS-REFERENCE TO RELATED APPLICATION

This application claims priority of Taiwanese Application No. 097129813, filed on Aug. 6, 2008.

BACKGROUND OF THE INVENTION

1. Field of the Invention

The present invention relates to a fire detecting system, more particularly to a fire detecting system capable of performing a weight correcting method for enhancing accuracy of fire detection.

2. Description of the Related Art

Generally, a conventional fire detecting system directly sends a signal generated by a smoke detector or a flame detector to a receiving server for detecting a fire state. However, likelihood of inaccurate actuation of the smoke detector or the flame detector is considerably high such that a false fire alarm is unavoidable. Therefore, an improved fire detecting system including a plurality of detectors with constant weight values has been proposed heretofore for enhancing the accuracy of the fire detection.

However, it is possible that different types of detectors are inaccurately actuated due to different environmental conditions. For example, inaccurate actuation of the smoke detector easily occurs in a smoky place, such as a kitchen, a smoking area, etc., and inaccurate actuation of the flame detector easily occurs in a place near a stove. As a result, various environmental factors can cause false fire alarms. Therefore, it is inappropriate to employ such fire detecting system including a plurality of detectors with constant weight values in practice.

SUMMARY OF THE INVENTION

Therefore, an object of the present invention is to provide a fire detecting system capable of correcting weight values of detectors thereof for enhancing accuracy of fire detection.

Accordingly, a fire detecting system of this invention comprises a plurality of detectors, and a computing unit coupled to the detectors. The detectors are configured for generating a plurality of detecting values, respectively. For each of the detectors, the detecting value is equal to a first predetermined value when a fire state is detected thereby, and is equal to a second predetermined value when otherwise. The computing unit sets a weight value for each of the detectors and a threshold value, and is configured to perform a weight correcting method including the steps of:

computing a summation of products of each of the detecting values and the weight value of the respective one of the detectors;

when the computed summation is greater than the threshold value, adding a first adjusting value to the weight value corresponding to the detector from which the detecting value equal to the first predetermined value is obtained, and adding a first correcting value to the weight value corresponding to the detector from which the detecting value equal to the second predetermined value is obtained; and when the computed summation is smaller than the threshold value, adding a second correcting value to the weight value corresponding to the detector from which the detecting value equal to the first predetermined value is obtained, and adding a second adjusting value to the weight value corresponding to the detector from which the detecting value equal to the second predetermined value is obtained.

Another object of the present invention is to provide a weight correcting method for a fire detecting system that includes a plurality of detectors configured for detecting a fire state.

According to another aspect of this invention, a weight correcting method comprises:

a) setting weight values for the detectors, respectively;

b) setting a threshold value;

c) receiving a plurality of detecting values, each of which is obtained using a respective one of the detectors, wherein, for each of the detectors, the detecting value is equal to a first predetermined value when the fire state is detected thereby, and is equal to a second predetermined value when otherwise;

d) computing a summation of products of each of the detecting values and the weight value of the respective one of the detectors;

e) when the summation computed in step d) is greater than the threshold value, adding a first adjusting value to the weight value corresponding to the detector from which the detecting value equal to the first predetermined value is obtained, and adding a first correcting value to the weight value corresponding to the detector from which the detecting value equal to the second predetermined value is obtained; and f) when the summation computed in step d) is smaller than the threshold value, adding a second correcting value to the weight value corresponding to the detector from which the detecting value equal to the first predetermined value is obtained, and adding a second adjusting value to the weight value corresponding to the detector from which the detecting value equal to the second predetermined value is obtained.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
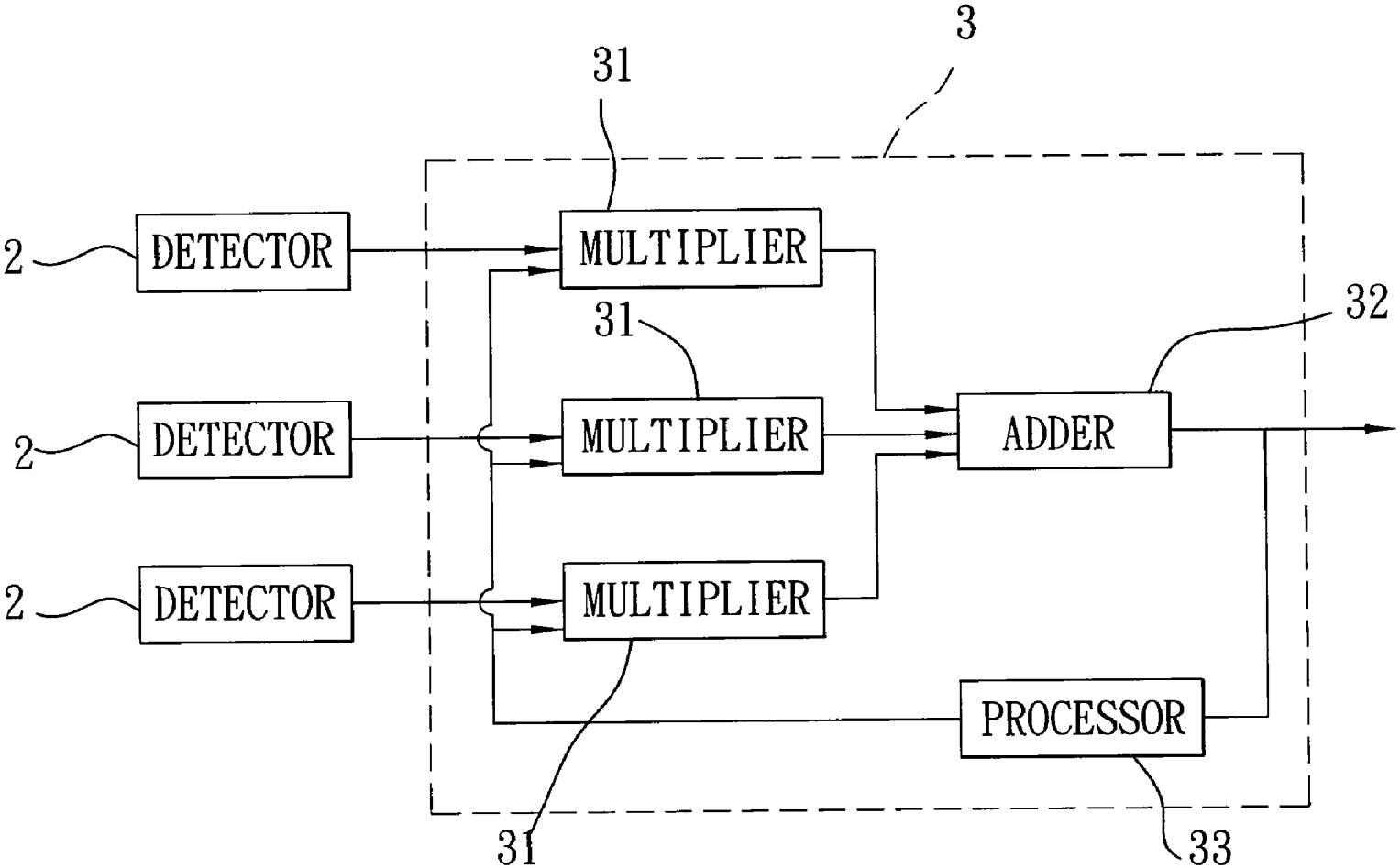
FIG. 1 is a schematic block diagram of a first preferred embodiment of a fire detecting system according to the present invention.

Before the present invention is described in greater detail, it should be noted that like elements are denoted by the same reference numerals throughout the disclosure.

Referring to FIG. 1, the first preferred embodiment of a fire detecting system of this invention includes three detectors 2 configured for detecting a fire state, and a computing unit 3 configured to perform a weight correcting method.

In this embodiment, the detectors 2 include different types of detectors, i.e., a smoke detector, a flame detector, and a temperature detector. In practice, the detectors 2 may include the same type of detectors, and are not limited to these disclosed herein. The detectors 2 generate a plurality of detecting values ($S_i$), respectively. For each of the detectors 2, the detecting value is equal to a first predetermined value when a fire state is detected thereby, and is equal to a second predetermined value when otherwise. In this embodiment, the first predetermined value is equal to 1, and the second predetermined value is equal to −1.

The computing unit 3 includes three multipliers 31 respectively coupled to the detectors 2 for receiving the detecting values therefrom, an adder 32 coupled to the multipliers 31, and a processor 33 coupled to the multipliers 31 and the adder 32. It should be noted that, in practice, the computing unit 3 can be implemented as a microprocessor.

Figure 2:
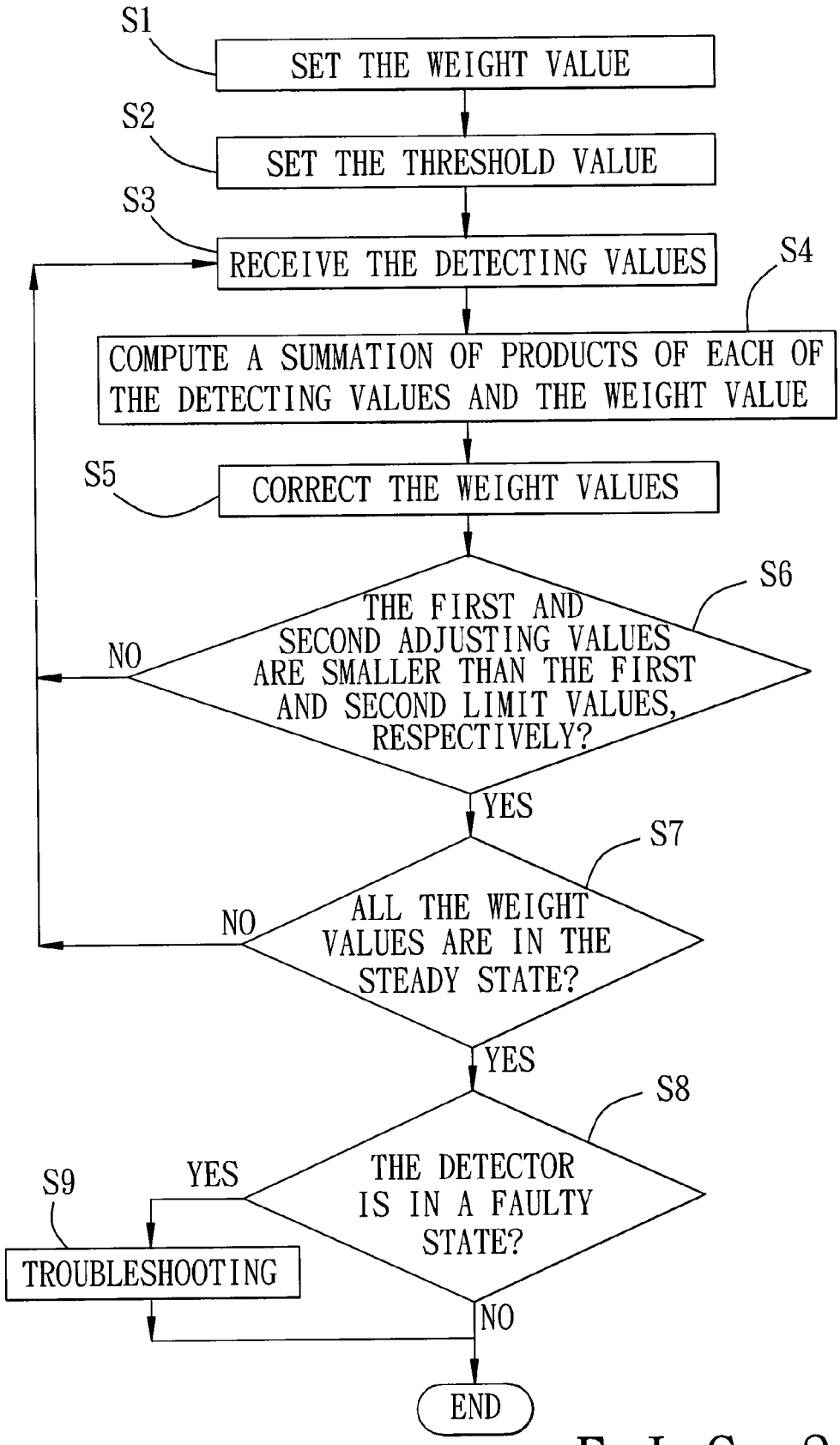
FIG. 2 is a flow chart of a weight correcting method performed by the fire detecting system of the first preferred embodiment.

Further referring to FIG. 2, the weight correcting method performed by the computing unit 3 includes the following steps.

Each of the multipliers 31 of the computing unit 3 is set with a weight value ($W_i$) corresponding to one of the detectors 2 coupled thereto in step (S1). In step (S2), the processor 33 is set with a threshold value (B) for determining whether the detected fire state is accurate. In this embodiment, the threshold value is equal to 0.

The multipliers 31 receive the detecting values ($S_i$) from the respective detectors 2 in step (S3). When one of the detecting values received in step (S3) is equal to the first predetermined value, the multipliers 3 compute products of each of the detecting values and the weight value of the respective one of the detectors 2, and the adder 32 computes a summation of the products in step (S4).

Step (S5) is to correct the weight values. When the summation computed in step (S4) is greater than the threshold value, i.e., $\Sigma S_i \times W_i > B$, the processor 33 adds a first adjusting value ($\Delta W_{1,i}^{+}$) to the weight value corresponding to the detector 2 from which the detecting value equal to the first predetermined value is obtained, and adds a first correcting value ($\Delta W_{1,i}^{-}$) to the weight value corresponding to the detector 2 from which the detecting value equal to the second predetermined value is obtained. When the summation computed in step (S4) is smaller than the threshold value, the processor 33 adds a second correcting value ($\Delta W_{-1,i}^{-}$) to the weight value corresponding to the detector 2 from which the detecting value equal to the first predetermined value is obtained, and adds a second adjusting value ($\Delta W_{-1,i}^{+}$) to the weight value corresponding to the detector 2 from which the detecting value equal to the second predetermined value is obtained. Preferably, the weight values are uncorrected in step (S5) when the summation computed in step (S4) is equal to the threshold value, i.e., $\Sigma S_i \times W_i = B$.

With reference to K. L. Su, "Multisensor Controlled Intelligent Security Robot System", 2003, the first and second adjusting values ($\Delta W_{1,i}^{+}$, $\Delta W_{-1,i}^{+}$) and the first and second correcting values ($\Delta W_{1,i}^{-}$, $\Delta W_{-1,i}^{-}$) can be obtained based upon the following equations:

$$\Delta W_{1,i}^{+} = \frac{1}{m_{1,i}},$$

$$\Delta W_{-1,i}^{+} = \frac{1}{m_{-1,i}},$$

$$\Delta W_{1,i}^{-} = -\frac{1}{m_{1,i}} \sum_{k=0}^{\infty} \frac{(W_i + W_0)^k}{k!}, \text{ and}$$

-continued $$\Delta W_{-1,i}^{-} = -\frac{1}{m_{-1,i}} \sum_{k=0}^{\infty} \frac{(W_i - W_0)^k}{k!},$$

wherein $m_{1,i}$ is a number of detections of the detecting value of the corresponding detector 2 being equal to the first predetermined value when $\Sigma S_i \times W_i > B$, $m_{-1,i}$ is a number of detections of the detecting value of the corresponding detector 2 being equal to the second predetermined value when $\Sigma S_i \times W_i < B$, and $W_0$ is an initial value of the weight value of the corresponding detector 2 obtained from a datasheet thereof.

It should be noted that the first and second predetermined values and the threshold value are not limited to the values (1, −1, and 0) used in this embodiment. In other embodiments, the first and second predetermined values can be set as 1 and 0, respectively, and the corresponding threshold value can be equal to 0.5. The first and second predetermined values and the threshold value should be set according to the environment.

Step (S6) is to determine whether the first and second adjusting values are smaller than first and second limit values, respectively. The first and second adjusting values are gradually decreased with an increase in the number of detections of the detecting value of the corresponding detector 2 being equal to the first and second predetermined values, respectively. Adding the first adjusting value to the weight value corresponding to the detector 2, from which the detecting value equal to the first predetermined value is obtained, is terminated in step (S5) when the first adjusting value corresponding to the detector 2 is smaller than a first limit value. Likewise, adding the second adjusting value to the weight value corresponding to the detector 2, from which the detecting value equal to the second predetermined value is obtained, is terminated in step (S5) when the second adjusting value corresponding to the detector 2 is smaller than a second limit value. That is to say, the weight value has converged to a steady state, and correction is no longer needed in step (S5). In this embodiment, the first and second limit values are equal to 0.005.

The flow goes to step (S7) when the determination made in step (S6) is affirmative to further determine whether all the weight values are in the steady state, and goes back to step (S3) when otherwise. Then, the flow goes to step (S8) of determining whether one of the detectors 2 is in a faulty state when the determination made in step (S7) is affirmative, and goes back to step (S3) when otherwise.

In step (S8), it is determined that one of the detectors 2 is in the faulty state if the weight value corresponding thereto becomes smaller than a minimum limit. For example, if the number of detections is greater than 400, and the weight value is still smaller than 1.2, it is determined that the detector 2 corresponding to the weight value is in the faulty state. The flow goes to step (S9) of troubleshooting when any one of the detectors 2 is in the faulty state determined in step (S8), and ends when otherwise.

The following description is provided to demonstrate the effect of the fire detecting system of this invention with two tests. It assumed that the three different types of the detectors 2 can detect the fire state simultaneously in the first test. Based upon the experimental result of the first test, each of the weight values corresponding to the three detectors 2 converges to the steady state after a particular number of detecting times.

Figure 3:
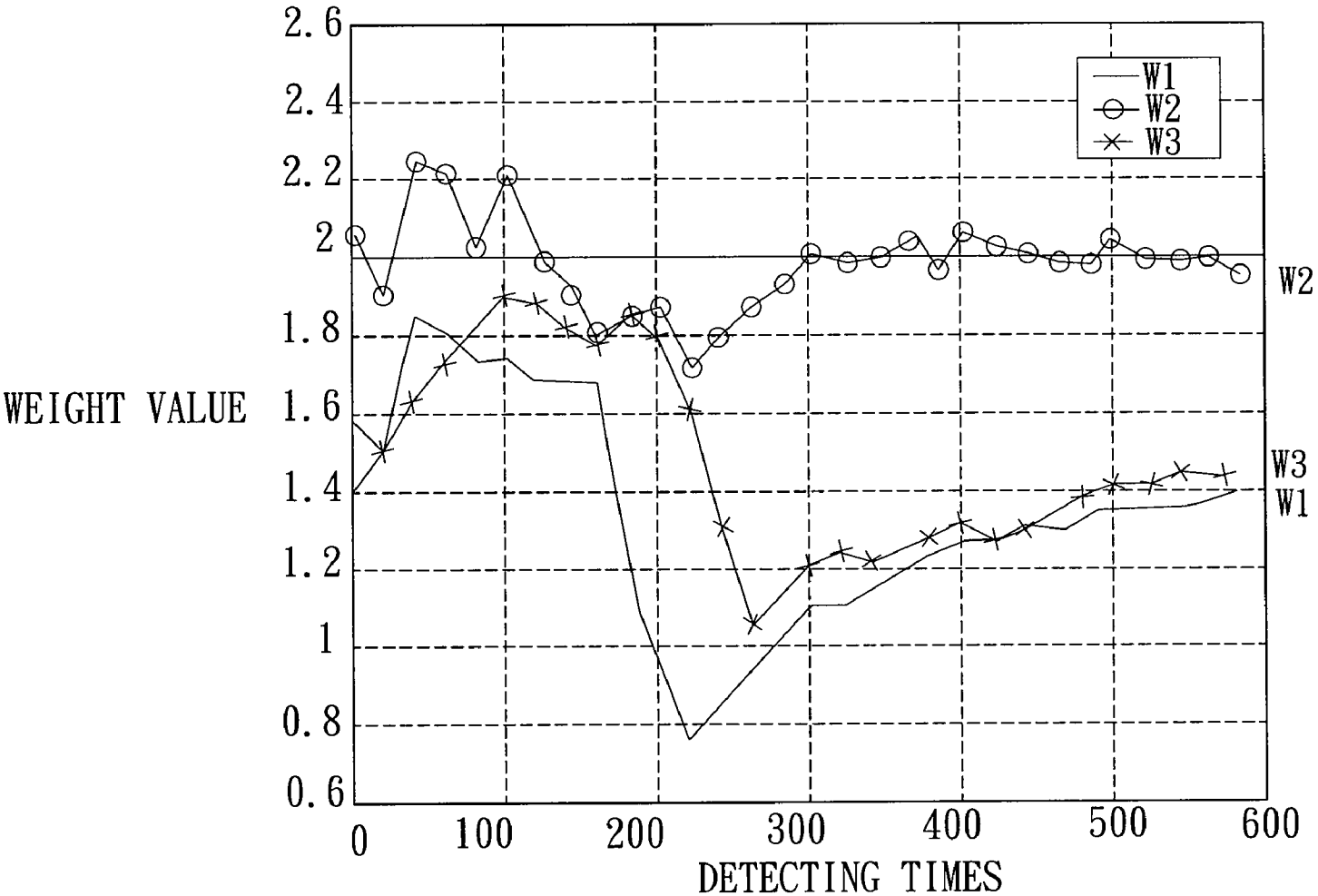
FIG. 3 is a plot illustrating variation of the weight values of the detectors of the fire detecting system in a second test which simulates a real situation of a fire state.

The condition of the second test simulates a real fire state, that is, smoke appears before flame and then the temperature of the environment rises. As shown in FIG. 3, the weight values of the three different types of the detectors 2 converge at different values, respectively. Further, when using the weight values obtained through the second test for detecting fire states and non-fire states, the accuracy is shown in the following table.

| Test Items | | Test Times | Accurate Times | Accuracy |
|---|---|---|---|---|
| Non-Fire | Cigarette smoke | 50 | 49 | 98% |
| State | Flame of a lighter | 50 | 48 | 96% |
| | Kitchen | 50 | 46 | 92% |
| Fire | Burning of wood | 50 | 47 | 94% |
| State | Burning of paper | 50 | 48 | 96% |

Figure 4:
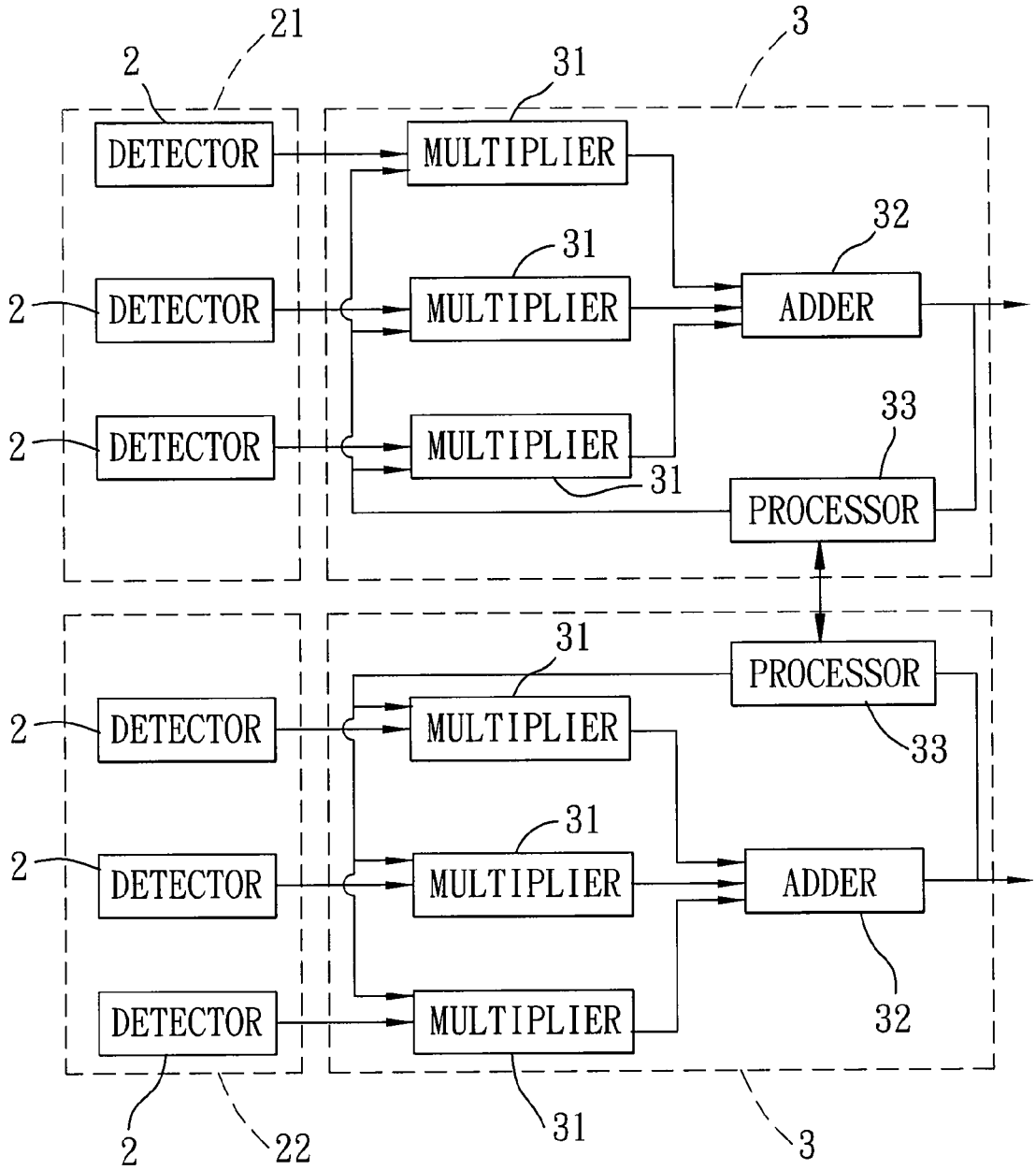
FIG. 4 is a schematic block diagram of a second preferred embodiment of a fire detecting system according to the present invention.

Referring to FIG. 4, the second preferred embodiment of the fire detecting system of this invention is shown to be similar to the first preferred embodiment. In this embodiment, the detectors 2 of the fire detecting system include first and second detector sets 21, 22. Each of the first and second detector sets 21,22 includes a smoke detector, a flame detector and a temperature detector. In this embodiment, the fire detecting system includes two computing units 3 coupled to the first and second detector sets 21, 22 for correcting the weight values of the detectors 2 in the detector sets 21, 22, respectively. It should be noted that the number of the computing units 3 is not limited in this embodiment, and the fire detecting system may include only one computing unit 3 in other embodiments. Further, the computing units 3 are configured to compare the weight value of each of the detectors 2 in the first detector set 21 with the weight value of the detector 2 of the same type in the second detector set 22 to determine relative accuracy therebetween. After determining relative accuracy, the computing units 3 are configured to exclude the relatively inaccurate one of the same type of the detectors 2 in the first and second detector sets 21, 22.

In sum, the computing unit 3 of the fire detecting system of this invention is capable of determining whether the detected fire state is accurate by comparing the threshold value and the summation of products of each of the detecting values and the weight value of the respective one of the detectors 2. Further, the computing unit 3 is configured to appropriately correct the weight values of the detectors 2, such that each of the weight values converges at an optimal value appropriate for the environment. For example, the weight value corresponding to the smoke detector becomes relatively small when the fire detecting system is placed in a smoky environment, such as a smoking area. Therefore, the accuracy of the fire detecting system is enhanced, and false fire alarms can be minimized through the fire detecting system.

While the present invention has been described in connection with what are considered the most practical and preferred embodiments, it is understood that this invention is not limited to the disclosed embodiments but is intended to cover various arrangements included within the spirit and scope of the broadest interpretation so as to encompass all such modifications and equivalent arrangements.

What is claimed is:

1. A weight correcting method for a fire detecting system that includes a plurality of detectors configured for detecting a fire state, said weight correcting method comprising:

a) setting weight values for the detectors, respectively;

b) setting a threshold value;

c) receiving a plurality of detecting values, each of which is obtained using a respective one of the detectors, wherein, for each of the detectors, the detecting value is equal to a first predetermined value when the fire state is detected thereby, and is equal to a second predetermined value when otherwise;

d) computing a summation of products of each of the detecting values and the weight value of the respective one of the detectors;

e) when the summation computed in step d) is greater than the threshold value, adding a first adjusting value to the weight value corresponding to the detector from which the detecting value equal to the first predetermined value is obtained, and adding a first correcting value to the weight value corresponding to the detector from which the detecting value equal to the second predetermined value is obtained; and f) when the summation computed in step d) is smaller than the threshold value, adding a second correcting value to the weight value corresponding to the detector from which the detecting value equal to the first predetermined value is obtained, and adding a second adjusting value to the weight value corresponding to the detector from which the detecting value equal to the second predetermined value is obtained.

2. The weight correcting method as claimed in claim 1, further comprising the step of:

g) repeating steps c) to f).

3. The weight correcting method as claimed in claim 2, wherein:

the first adjusting value in step e) is gradually decreased with an increase in the number of detections of the detecting value of the corresponding detector being equal to the first predetermined value; and the second adjusting value in step f) is gradually decreased with an increase in the number of detections of the detecting value of the corresponding detector being equal to the second predetermined value.

4. The weight correcting method as claimed in claim 3, wherein the first adjusting value is computed based upon the number of detections of the detecting value of the corresponding detector being equal to the first predetermined value, and the second adjusting value is computed based upon the number of detections of the detecting value of the corresponding detector being equal to the second predetermined value.

5. The weight correcting method as claimed in claim 4, wherein the first adjusting value is computed based upon a reciprocal of the number of detections of the detecting value of the corresponding detector being equal to the first predetermined value, and the second adjusting value is computed based upon a reciprocal of the number of detections of the detecting value of the corresponding detector being equal to the second predetermined value.

6. The weight correcting method as claimed in claim 3, wherein:

in step e), adding the first adjusting value to the weight value corresponding to the detector, from which the detecting value equal to the first predetermined value is obtained, is terminated when the first adjusting value corresponding to the detector is smaller than a first limit value; and in step f), adding the second adjusting value to the weight value corresponding to the detector, from which the detecting value equal to the second predetermined value is obtained, is terminated when the second adjusting value corresponding to the detector is smaller than a second limit value.

7. The weight correcting method as claimed in claim 3, further comprising the step of determining one of the detectors to be in a faulty state if the weight value corresponding to said one of the detectors becomes smaller than a minimum limit.

8. The weight correcting method as claimed in claim 1, the detectors including first and second detector sets, each of the first and second detector sets including a smoke detector, a flame detector and a temperature detector, further comprising the step of comparing the weight value of each of the detectors in the first detector set with the weight value of the detector of the same type in the second detector set to determine relative accuracy therebetween.

9. The weight correcting method as claimed in claim 1, wherein the first predetermined value is equal to 1, the second predetermined value is equal to −1, and the threshold value is equal to 0.

10. A fire detecting system comprising:

a plurality of detectors for generating a plurality of detecting values, respectively, wherein, for each of said detectors, the detecting value is equal to a first predetermined value when a fire state is detected thereby, and is equal to a second predetermined value when otherwise; and a computing unit coupled to said detectors, said computing unit setting a weight value for each of said detectors and a threshold value, and being configured to perform a weight correcting method including the steps of computing a summation of products of each of the detecting values and the weight value of the respective one of said detectors, when the computed summation is greater than the threshold value, adding a first adjusting value to the weight value corresponding to said detector from which the detecting value equal to the first predetermined value is obtained, and adding a first correcting value to the weight value corresponding to said detector from which the detecting value equal to the second predetermined value is obtained, and when the computed summation is smaller than the threshold value, adding a second correcting value to the weight value corresponding to said detector from which the detecting value equal to the first predetermined value is obtained, and adding a second adjusting value to the weight value corresponding to said detector from which the detecting value equal to the second predetermined value is obtained.

11. The fire detecting system as claimed in claim 10, wherein said detectors include different types of detectors.

12. The fire detecting system as claimed in claim 11, wherein said detectors include a smoke detector, a flame detector, and a temperature detector.

13. The fire detecting system as claimed in claim 10, wherein said detectors include first and second detector sets, each of said first and second detector sets including a smoke detector, a flame detector and a temperature detector, said computing unit being configured to compare the weight value of each of said detectors in said first detector set with the weight value of said detector of the same type in said second detector set to determine relative accuracy therebetween.

14. The fire detecting system as claimed in claim 10, wherein said computing unit is configured to perform the weight correcting method repeatedly.

15. The fire detecting system as claimed in claim 14, wherein said computing unit gradually decreases the first adjusting value with an increase in the number of detections of the detecting value of the corresponding one of said detectors being equal to the first predetermined value, and gradually decreases the second adjusting value with an increase in the number of detections of the detecting value of the corresponding one of said detectors being equal to the second predetermined value.

16. The fire detecting system as claimed in claim 15, wherein said computing unit computes the first adjusting value based upon the number of detections of the detecting value of the corresponding one of said detectors being equal to the first predetermined value, and computes the second adjusting value based upon the number of detections of the detecting value of the corresponding one of said detectors being equal to the second predetermined value.

17. The fire detecting system as claimed in claim 16, wherein said computing unit computes the first adjusting value based upon a reciprocal of the number of detections of the detecting value of the corresponding one of said detectors being equal to the first predetermined value, and computes the second adjusting value based upon a reciprocal of the number of detections of the detecting value of the corresponding one of said detectors being equal to the second predetermined value.

18. The fire detecting system as claimed in claim 15, wherein:

said computing unit terminates adding the first adjusting value to the weight value corresponding to said detector, from which the detecting value equal to the first predetermined value is obtained, when the first adjusting value corresponding to said detector is smaller than a first limit value; and said computing unit terminates adding the second adjusting value to the weight value corresponding to said detector, from which the detecting value equal to the second predetermined value is obtained, when the second adjusting value corresponding to said detector is smaller than a second limit value.

19. The fire detecting system as claimed in claim 15, wherein said computing unit is further configured to determine one of said detectors to be in a faulty state if the weight value corresponding to said one of said detectors becomes smaller than a minimum limit.

20. The fire detecting system as claimed in claim 10, wherein the first predetermined value is equal to 1, the second predetermined value is equal to −1, and the threshold value is equal to 0.

* * * * *